US010526784B2

(12) United States Patent
Czyzewicz et al.

(10) Patent No.: US 10,526,784 B2
(45) Date of Patent: Jan. 7, 2020

(54) SYSTEM AND APPARATUS FOR A YOKE STRUCTURE IN A CEILING SUSPENSION

(71) Applicant: CertainTeed Ceilings Corporation, Malvern, PA (US)

(72) Inventors: Robin Czyzewicz, Wilmington, DE (US); Thomas G. Murray, Collegeville, PA (US); Stephen Engel, Hamilton (CA)

(73) Assignee: CERTAINTEED CEILINGS CORPORATION, Malvern, PA (US)

( * ) Notice: Subject to any disclaimer, the term of this patent is extended or adjusted under 35 U.S.C. 154(b) by 0 days.

(21) Appl. No.: 15/624,767

(22) Filed: Jun. 16, 2017

(65) Prior Publication Data

US 2017/0362828 A1 Dec. 21, 2017

Related U.S. Application Data

(60) Provisional application No. 62/352,370, filed on Jun. 20, 2016.

(51) Int. Cl.

| | |
|---|---|
| ***E04B 9/06*** | (2006.01) |
| ***E04B 9/00*** | (2006.01) |
| *E04B 1/32* | (2006.01) |

(52) U.S. Cl.

CPC ..... *E04B 9/006* (2013.01); *E04B 9/067* (2013.01); *E04B 2001/3252* (2013.01)

(58) Field of Classification Search

CPC ... E04B 9/006; E04B 9/067; E04B 2001/3252
See application file for complete search history.

(56) References Cited

U.S. PATENT DOCUMENTS

| | | | | |
|---|---|---|---|---|
| 3,035,672 A * | 5/1962 | Tuten | E04B 9/04 | 52/506.07 |
| 3,089,570 A * | 5/1963 | O'Neil, Jr. | E04B 9/14 | 52/506.07 |
| 3,216,537 A * | 11/1965 | Nelsson | E04B 1/99 | 403/219 |
| 3,343,310 A * | 9/1967 | Netz | E04B 9/006 | 362/150 |
| 3,677,589 A * | 7/1972 | Roles | E04B 9/127 | 403/217 |
| 4,479,341 A | 10/1984 | Schuplin | | |
| 4,481,745 A * | 11/1984 | Smits | E04B 9/006 | 52/220.6 |

(Continued)

OTHER PUBLICATIONS

International Search Report for PCT/US17/37818, dated Sep. 5, 2017, 1 page.

*Primary Examiner* — Brent W Herring
(74) *Attorney, Agent, or Firm* — Abel Schillinger, LLP; Thomas H. Osborn

(57) ABSTRACT

A yoke for a ceiling suspension system is disclosed. For example, the yoke may include a yoke body having an upper end configured to be mounted only to another yoke, or to an extension mounted to the other yoke. The yoke body may have a lower end having a first mount configured to be mounted to a first ceiling support member (CSM), and a second mount configured to be mounted to a second CSM that differs from the first CSM. In one version, no portion of the yoke body extends through any portion of the first CSM and the second CSM.

14 Claims, 6 Drawing Sheets

(56) References Cited

U.S. PATENT DOCUMENTS 4,580,387 A * 4/1986 Rogers ..... E04B 9/10 52/506.07
4,583,340 A * 4/1986 Sauer ..... E04B 9/127 52/506.07
4,723,749 A 2/1988 Carraro et al.
D309,027 S 7/1990 Noone et al.
5,046,294 A 9/1991 Platt
5,941,029 A * 8/1999 MacLeod ..... E04B 9/006 24/336
6,341,466 B1 1/2002 Kehoe et al.
6,345,800 B1 2/2002 Herst et al.
6,612,087 B2 * 9/2003 diGirolamo ..... E04B 2/767 403/403
7,104,024 B1 * 9/2006 diGirolamo ..... E04B 2/767 403/231
7,255,315 B2 8/2007 Oh
7,293,393 B2 11/2007 Kelly et al.
7,552,567 B2 6/2009 Ingratta et al.
7,614,195 B2 11/2009 Platt et al.
D608,619 S * 1/2010 Gulbrandsen ..... D8/354
7,673,429 B2 * 3/2010 Frecska ..... E04B 9/127 403/187
D617,913 S 6/2010 Shanes et al.
7,770,349 B2 8/2010 Tedesco et al.
7,788,872 B2 9/2010 Platt
D637,899 S 5/2011 Tedesco et al.
D638,286 S 5/2011 Tedesco et al.
D638,287 S 5/2011 Tedesco et al.
D638,288 S 5/2011 Tedesco et al.
D638,289 S 5/2011 Tedesco et al.
8,087,631 B1 1/2012 Gretz
D662,809 S 7/2012 Zhang
D664,029 S * 7/2012 Mathur ..... D8/380
8,336,843 B2 12/2012 Gulbrandsen et al.
8,338,719 B2 * 12/2012 Lehane ..... E04B 9/006 174/480
8,453,407 B2 * 6/2013 Tedesco ..... E04B 9/127 52/167.1
8,615,497 B1 12/2013 Underkofler et al.
8,615,947 B2 * 12/2013 Underkofler ..... E04B 9/18 248/317
8,720,147 B2 5/2014 Roman
8,955,273 B1 * 2/2015 Lehane, Jr. ..... E04B 9/122 52/220.6
D736,606 S * 8/2015 Underkofler ..... D8/373
9,255,403 B1 * 2/2016 Lehane ..... E04B 9/067
9,663,948 B2 * 5/2017 Lehane ..... E04B 9/067
9,909,312 B2 * 3/2018 Lehane ..... E04B 9/34
2005/0160696 A1 7/2005 Kelly et al.
2008/0060306 A1 3/2008 Platt et al.
2009/0165417 A1 7/2009 Jankovec et al.
2010/0139190 A1 6/2010 Lehane et al.
2011/0011023 A1 1/2011 Gulbrandsen et al.
2011/0146194 A1 6/2011 Tedesco et al.
2011/0155865 A1 6/2011 Oh
2013/0318905 A1 12/2013 Underkofler et al.
2015/0040495 A1 * 2/2015 Lehane, Jr. ..... E04B 9/122 52/220.6

* cited by examiner

SYSTEM AND APPARATUS FOR A YOKE STRUCTURE IN A CEILING SUSPENSION

CROSS-REFERENCE TO RELATED APPLICATION

This Application claims priority under 35 U.S.C. § 119(e) to U.S. Provisional Application No. 62/352,370, entitled "SYSTEM AND APPARATUS FOR A YOKE STRUCTURE IN A CEILING SUSPENSION," by Robin CZYZEWICZ et al., filed Jun. 20, 2016, which is assigned to the current assignee hereof and is incorporated herein by reference in its entirety.

BACKGROUND OF THE INVENTION

Field of the Disclosure

The present invention relates in general to ceilings and, in particular, to a system and apparatus for a yoke structure in a ceiling suspension.

Description of the Prior Art

As shown in FIG. 1, conventional ceiling systems 21 may include a plurality of support members. The support members may be configured in many forms, such as main beams or runners 23 and cross tees 25 that rest on top of and are fastened to wall angle 26. A typical support member or grid member includes a top with a bulb 31, a web 33 extending downward from the bulb 31, and a bottom with a flange 35 extending from the web 33 opposite the bulb 31. The support members may be suitably roll-formed steel or aluminum, extruded aluminum, plastic, or fiber-reinforced plastic, depending on the application.

The support members for the ceiling system interconnect to form a ceiling suspension. The ceiling suspension may be suspended with wires or hangers 27 from a roof or floor support structure (not shown) in a building. The main runners 23, cross tees 25 and wall angle 26 may be substantially perpendicular, such that the ceiling suspension forms an orthogonal grid for supporting drywall panels (e.g., gypsum panels; not shown) below flanges 35 or ceiling tiles 29 above flanges 35, as is known by those of ordinary skill in the art. The panels or tiles are supported by the ceiling suspension to form a more aesthetically appealing ceiling beneath the usually less appealing exposed structure of a building.

Conventional ceiling suspensions also support various other auxiliary components, such as light fixtures and ventilation conduits. These components must be circumvented by the grid, while maintaining the structural integrity of the ceiling suspension. Typically, a two-piece yoke structure spans the component being circumvented. For example, one type of yoke is disclosed in U.S. Pat. No. 8,615,947. Although that yoke and other yoke designs exist in the market and are feasible, improvements in yoke structures for ceiling suspension systems continue to be of interest.

SUMMARY

Embodiments of a system, method and apparatus for a yoke structure for a ceiling suspension are disclosed. For example, the yoke may include a yoke body having an upper end configured to be mounted only to another yoke, or to an extension mounted to said another yoke. The yoke body may have a lower end having a first mount configured to be mounted to a first ceiling support member (CSM), and a second mount configured to be mounted to a second CSM that differs from the first CSM. In one version, no portion of the yoke body extends through any portion of the first CSM and the second CSM.

In another embodiment, a yoke may include at least one of a first mount and a second mount to be configured to mount to both sides of a respective CSM, including both sides of a bulb and both sides of a web of the respective CSM.

Some versions of a yoke for a ceiling suspension may include an upper end of a yoke body that may be directly connected to only a first mount of the yoke body. In addition, second mount of the yoke body may be directly connected to the first mount, but not to the upper end of the yoke body.

Still another embodiment of a yoke may include first and second mounts that are configured to face each other on facing sides of a first CSM and a second CSM, respectively.

Yet another version of a yoke for a ceiling suspension may include first and second mounts. In this embodiment, at least one of upper edges and lower edges of the first and second mounts may be substantially co-planar with each other.

Embodiments of a yoke system for a ceiling suspension may include a grid having a plurality of ceiling support members (CSM), and a ceiling component located in a discontinuity of the grid between at least two of the CSM. Examples of the yoke system may include a pair of yokes configured to be mounted directly to each other and to the grid for reinforcing the grid across the discontinuity. The pair of yokes may be configured to circumvent the ceiling component by going directly over a top of the ceiling component. Embodiments of each yoke may include at least one of the following: no portion of the yoke is configured to extend through any portion of a CSM; first and second mounts, at least one of which is configured to mount to both sides of a respective CSM, including both sides of a bulb and both sides of a web of the respective CSM; an upper end and two mounts, wherein the upper end is directly connected to only one of the mounts, and the other of the mounts is directly connected to said only one of the mounts but not to the upper end; first and second mounts are configured to face each other on facing sides of respective CSM; and first and second mounts, each with upper and lower edges, and wherein at least one of the upper edges of the first and second mounts and the lower edges of the first and second mounts are substantially co-planar with each other.

Embodiments of a yoke assembly for a ceiling suspension may include a pair of yokes mounted directly to each other and to the grid for reinforcing the grid across the discontinuity. The pair of yokes circumvent the ceiling component by going directly over a top of the ceiling component. Examples of each yoke may include at least one of the following: no portion of the yoke extends through any portion of a CSM; first and second mounts, at least one of which is mounted to both sides of a respective CSM, including both sides of a bulb and both sides of a web of the respective CSM; an upper end and two mounts, wherein the upper end is directly connected to only one of the mounts, and the other of the mounts is directly connected to said only one of the mounts but not to the upper end; first and second mounts that face each other on facing sides of respective CSM; and first and second mounts, each with upper and lower edges, and wherein at least one of the upper edges of the first and second mounts and the lower edges of the first and second mounts are substantially co-planar with each other.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
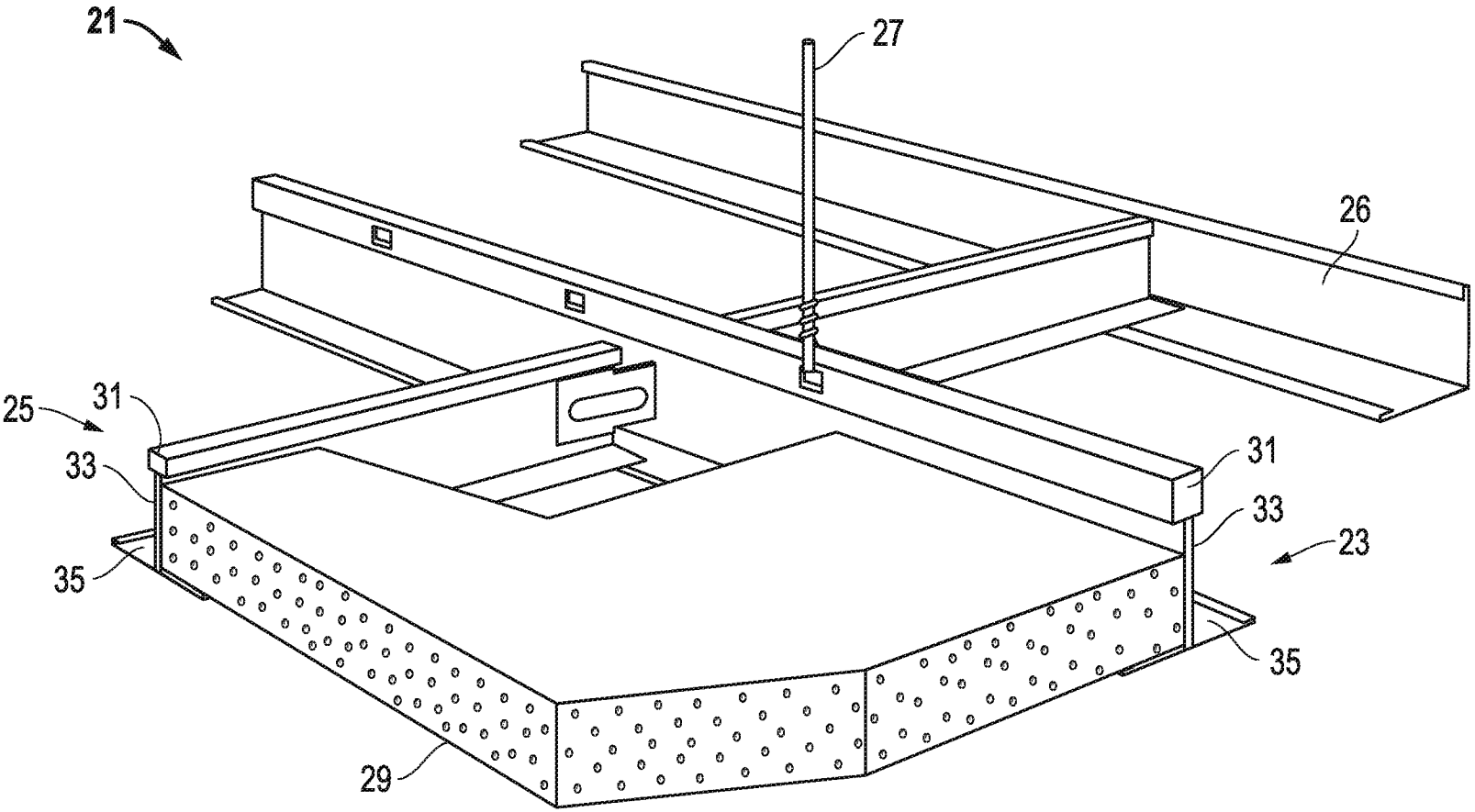
FIG. 1 (Prior Art)
FIG. 1 is a top isometric view of a conventional ceiling suspension system.
Figure 2:
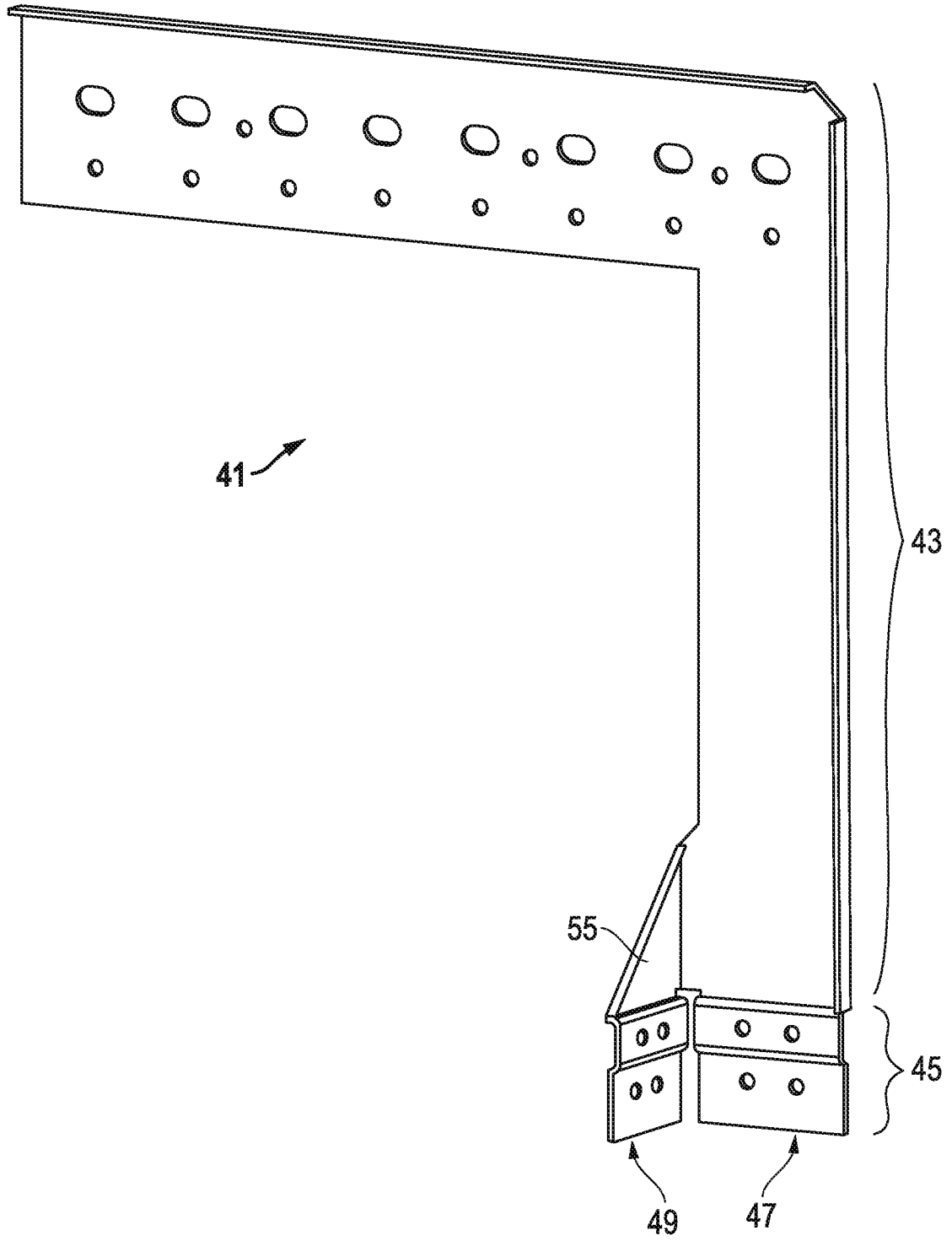
FIG. 2 is a top, front isometric view of an embodiment of a yoke.

Embodiments of a system, method and apparatus for a yoke structure for a ceiling suspension are disclosed. For example, as depicted in FIGS. 2-6, an embodiment of a yoke 41 may include a yoke body having an upper end 43 and a lower end 45. The upper end 43 may be configured to be mounted only to another yoke 41 (see, e.g., FIG. 3), such as with fasteners like screws. In another example, an extension (not shown), such as a portion of a ceiling support member (CSM) may be used to connect the yokes 41. Examples of a CSM may include a main beam, a runner, a cross-tee and a wall support member, as is known to those of ordinary skill in the art of ceiling suspensions. In some versions, the upper end 43 of yoke 41 is configured to only be mounted to the upper end 43 of another yoke 41, as shown, or to an extension mounted to the upper end of said another yoke.

Embodiments of the lower end 45 of the yoke body may include a first mount 47 and a second mount 49. Versions of the first mount 47 may be configured to be mounted to a first CSM 51. Versions of the second mount 49 may be configured to be mounted to a second CSM 53 that differs from the first CSM 51. In addition, embodiments of the yoke 41 may include no portion of the yoke body that extends through any portion of the first CSM 51 and the second CSM 53.

Figure 3:
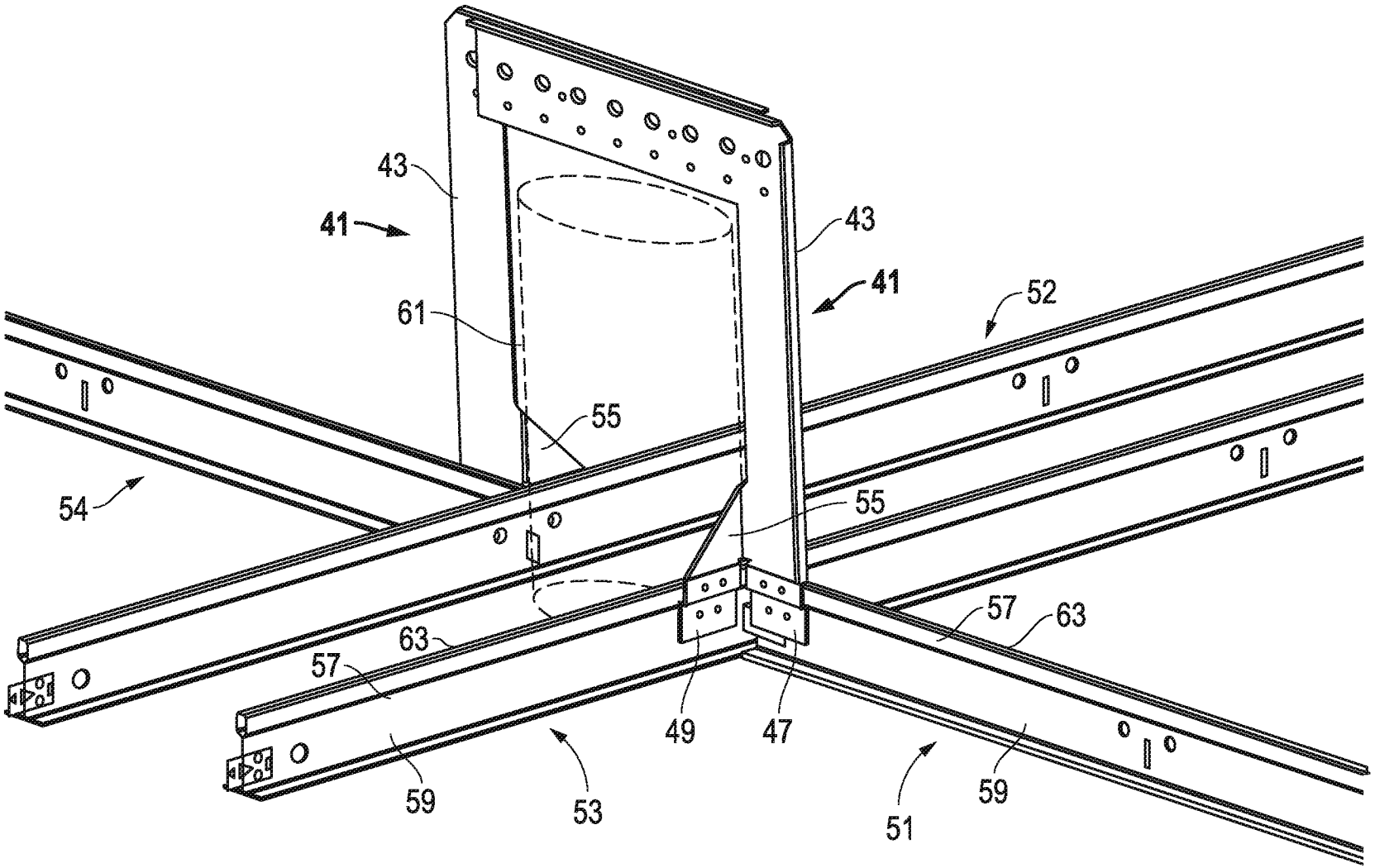
FIG. 3 is a top isometric view of two of the yokes of FIG. 2 in a ceiling suspension system.

Versions of the yoke 41 may be configured to be attached adjacent to an intersection of the first CSM 51 and the second CSM 53. In addition, an example of the yoke 41 may not be configured to extend over an intersection between other CSM 52, 54 (FIG. 3). Rather, yokes 41 may simply be adjacent to the intersections of CSM 51, 53 and 52, 54.

Embodiments of the yoke 41 may be configured to not attach to and not structurally support a ceiling component 61 (FIG. 3). For example, the ceiling component may comprise a light fixture, a ventilation conduit and the like. In a particular embodiment, the yoke 41 is not a seismic separation joint clip, such as the clip disclosed in U.S. Design Pat. D662,809.

As illustrated in the drawings, the upper end 43 of the yoke body may be generally L-shaped and integrally formed with the first and second mounts 47, 49 from sheet metal. Examples of the first and second mounts 47, 49 can be oriented in different directions, such as the substantially perpendicular directions shown. Versions of the first and second mounts 47, 49 can be substantially identical to each other. One of the first and second mounts 47, 49 can be offset from the upper end 43 of the yoke 41. For example, the version illustrated second mount 49 is offset from upper end 43 with a flange 55 that protrudes from upper end 43. 19. Thus, the yoke 41 may be configured to be directly connected to both of the first and second mounts 47, 49.

Figure 4:
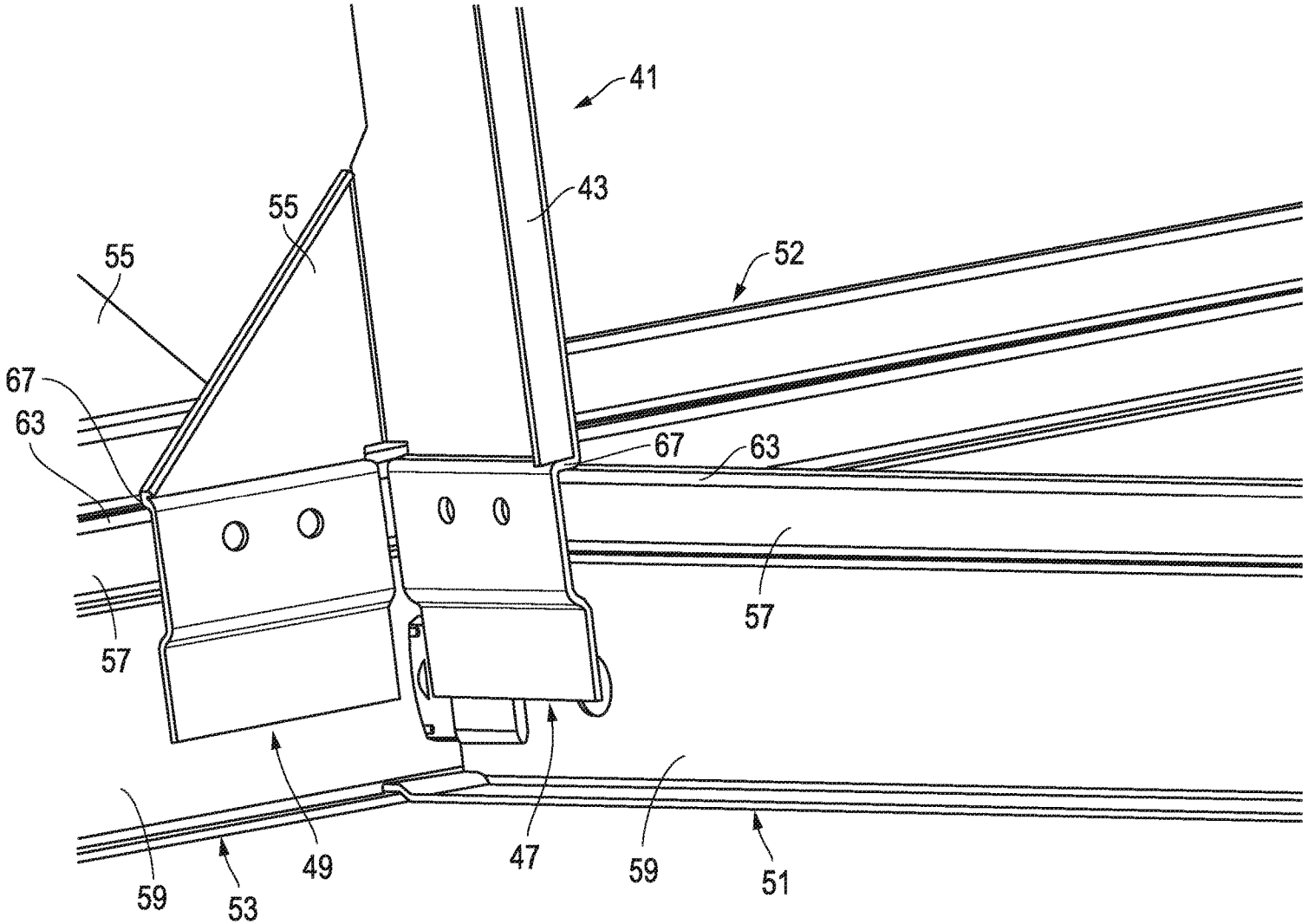
FIG. 4 is an enlarged isometric view of a portion of the system of FIG. 3.

In some examples of the yoke 41, at least one of the first and second mounts 47, 49 may be configured to mount to only one side of a respective CSM 51, 53. As shown in FIG. 4, the only side of the respective CSM 51, 53 may include only one side of a bulb 57 and only one side of a web 59 of the respective CSM 51, 53. In the particular version illustrated, both of the first and second mounts 47, 49 may be configured to mount to only one side of a respective CSM 51, 53, such that each of the first and second mounts 47, 49 substantially follows a contour of the bulb 57 and the web 59 of the respective CSM 51, 53. In these embodiments, the first and second mounts 47, 49 may be configured to only rest against respective CSM 51, 53, and then (optionally) secured with fasteners such as screws (not shown).

Embodiments of the yoke 41 may include both of the first and second mounts 47, 49 being configured to be mounted to a top 63 of a respective CSM 51, 53. Some versions of the first and second mounts 47, 49 may be configured to face each other on facing sides of the first and second CSM 51, 53, respectively, as shown. In other versions, upper edges 67 of the first and second mounts 47, 49 can be substantially co-planar with each other. Embodiments of lower edges 69 of the first and second mounts 47, 49 can be substantially co-planar with each other.

Figure 5:
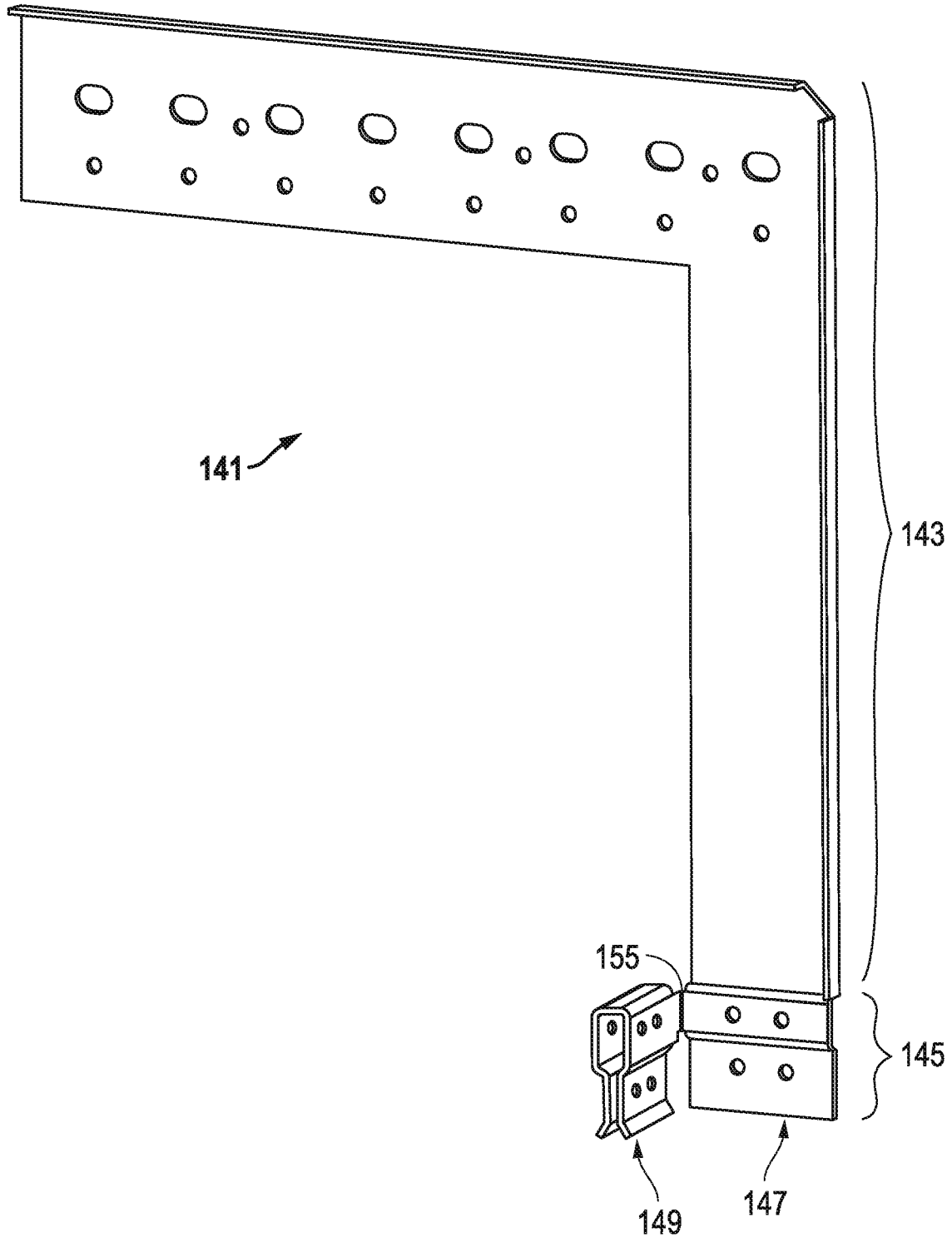
FIG. 5 is a top isometric view of another embodiment of a yoke.
Figure 6:
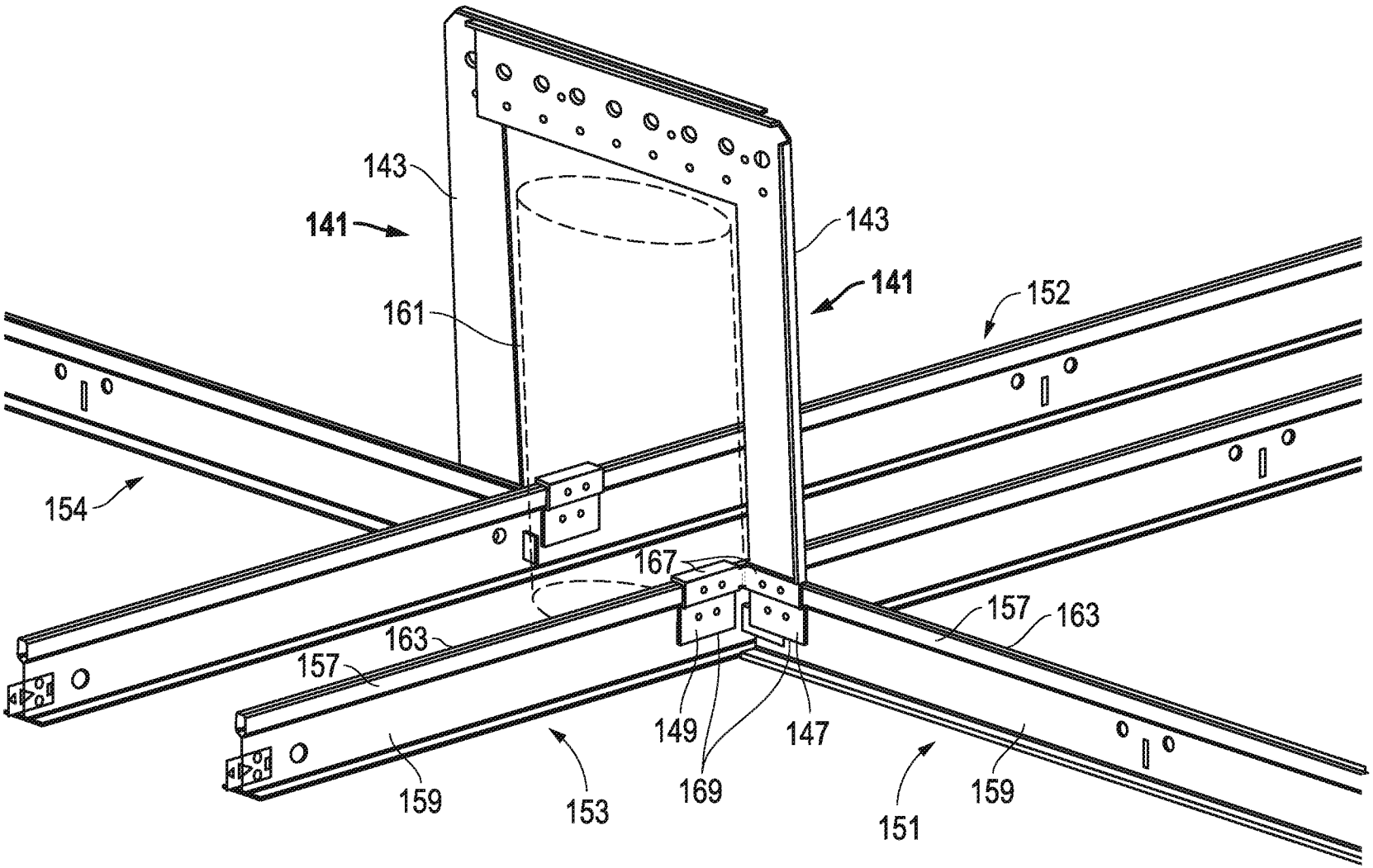
FIG. 6 is a top isometric view of two of the yokes of FIG. 5 in a ceiling suspension system.

FIGS. 5 and 6 depict another embodiment of a yoke 141. For ease of reference, the same identifying numerals used for yoke 41 are used for yoke 141, but in three digit form (e.g., "1xx"). For example, yoke 41 comprises upper end 43, and yoke 141 comprises upper end 143. In an embodiment, the yoke 141 may comprise first and second mounts 147, 149 that differ from each other. In some versions, at least one of the first and second mounts 147, 149 may be configured to mount to both sides of a respective CSM 151, 153. For example, second mount 149 may be configured to mount to both sides of CSM 153, including the top 163, both sides of the bulb 157 and both sides of the web 159 of CSM 153. In addition, the shape of second mount 149 may be configured to accommodate any shape of bulb 157, including rectangular, peak, etc. 12. Versions of the yoke 141 may include the first mount 147 being one-sided and configured to engage the top 163, only one side of the bulb 157 and only one side of the web 159 of the first CSM 151.

In some embodiments, the upper end 143 of the yoke 141 may be directly connected to only one of the mounts 147, 149. For example, the upper end 143 can be directly connected to only the first mount 147, but not to the second mount 149. Versions of yoke 141 may include directly connecting the first and second mounts 147, 149 with a rigid flange 155 (FIG. 5).

An alternate embodiment of yoke 41 or yoke 141 may further comprise a third mount (not shown). For example, the third mount may be located opposite the second mount 47, 147, respectively. The second mount 49, 149 and the third mount can be substantially perpendicular to the first mount 47, 149, respectively. In such embodiments, the lower end 45, 145 of the yoke 41, 141, respectively can be generally T-shaped.

Embodiments of a yoke system and a yoke assembly for a ceiling suspension also are disclosed. For example, the ceiling suspension may include a grid comprising a plurality of CSM 151-154 (FIGS. 5-6). A ceiling component 161 may be located in a discontinuity of the grid between at least two of the CSM 151-154. In an example, the yoke system may include a pair of yokes 141 that may be configured to be mounted directly to each other and to the grid for reinforcing the grid across the discontinuity. For larger discontinuities (e.g., spans greater than about 12 inches), an extension such as a portion of a CSM may be used to span the greater distance between the yokes 141. The pair of yokes 141 may be configured to circumvent the ceiling component 161 by going directly over a top of the ceiling component 161. In addition, each yoke 141 may include at least one of the following features or elements:

a. no portion of the yoke 141 is configured to extend through any portion of a CSM 151-154;
b. first and second mounts 147, 149, at least one of which is configured to mount to both sides of a respective CSM 151, 153, including both sides of the bulb 157 and both sides of the web 159 of the respective CSM 151, 153;
c. an upper end 143 and two mounts 147, 149, wherein the upper end 143 is directly connected to only one of the mounts 147, and the other of the mounts 149 is directly connected to said only one of the mounts 147 but not to the upper end 143;
d. first and second mounts 147, 149 configured to face each other on facing sides of respective CSM 151, 153; and
e. first and second mounts 147, 149, each with upper edges 167 and lower edges 169, and wherein at least one of the upper edges 167 of the first and second mounts 147, 149 and the lower edges 169 of the first and second mounts 147, 149 are substantially co-planar with each other.

Still other versions may include one or more of the following embodiments:

Embodiment 1

A yoke for a ceiling suspension system, the yoke comprising: a yoke body having an upper end configured to be mounted only to another yoke, or to an extension mounted to said another yoke, a lower end of the yoke body comprising a first mount configured to be mounted to a first ceiling support member (CSM) and a second mount configured to be mounted to a second CSM that differs from the first CSM, and wherein no portion of the yoke body extends through any portion of the first CSM and the second CSM.

Embodiment 2

The yoke of any of these embodiments, wherein the upper end of the yoke body is generally L-shaped and integrally formed with the first and second mounts from sheet metal.

Embodiment 3

The yoke of any of these embodiments, wherein the first and second mounts are substantially identical to each other.

Embodiment 4

The yoke of any of these embodiments, wherein the first and second mounts differ from each other.

Embodiment 5

The yoke of any of these embodiments, wherein the first and second mounts are oriented in different directions.

Embodiment 6

The yoke of any of these embodiments, wherein the first and second mounts are substantially perpendicular to each other.

Embodiment 7

The yoke of any of these embodiments, wherein one of the first and second mounts is offset from the upper end of the yoke.

Embodiment 8

The yoke of any of these embodiments, wherein at least one of the first and second mounts is configured to mount to both sides of a respective CSM, including both sides of a bulb and both sides of a web of the respective CSM.

Embodiment 9

The yoke of any of these embodiments, wherein at least one of the first and second mounts is configured to mount to only one side of a respective CSM, including only one side of a bulb and only one side of a web of the respective CSM.

Embodiment 10

The yoke of any of these embodiments, wherein both of the first and second mounts are configured to mount to only one side of a respective CSM, such that each of the first and second mounts substantially follows a contour of a bulb and a web of the respective CSM.

Embodiment 11

The yoke of any of these embodiments, wherein both of the first and second mounts are configured to mount to a top of a respective CSM.

Embodiment 12

The yoke of any of these embodiments, wherein the first mount is one-sided and configured to engage a top, only one side of a bulb and only one side of a web of the first CSM, and the second mount is two-sided and configured to engage a top, both sides of a bulb and both sides of a web of the second CSM.

Embodiment 13

The yoke of any of these embodiments, wherein the yoke is configured to not attach to and not structurally support a ceiling component.

Embodiment 14

The yoke of any of these embodiments, wherein the ceiling component comprises a light fixture or a ventilation conduit.

Embodiment 15

The yoke of any of these embodiments, wherein the yoke is not a seismic separation joint clip.

Embodiment 16

The yoke of any of these embodiments, wherein the yoke is configured to be attached adjacent to an intersection of the first CSM and the second CSM, and the yoke is not configured to extend over an intersection between other CSM.

Embodiment 17

The yoke of any of these embodiments, wherein the first and second mounts are configured to only rest against respective CSM.

Embodiment 18

The yoke of any of these embodiments, wherein at least one of the first and second mounts is configured to be fastened to a respective CSM with at least one fastener.

Embodiment 19

The yoke of any of these embodiments, wherein the yoke is directly connected to both of the mounts.

Embodiment 20

The yoke of any of these embodiments, wherein the yoke is directly connected to only one of the mounts, and the other of the mounts is directly connected to said only one of the mounts but not to the upper end.

Embodiment 21

The yoke of any of these embodiments, wherein each CSM comprises a main beam, a runner, a cross-tee or a wall support member.

Embodiment 22

The yoke of any of these embodiments, further comprising a third mount located opposite the second mount, the second and third mounts are substantially perpendicular to the first mount, such that the lower end of the yoke is generally T-shaped.

Embodiment 23

The yoke of any of these embodiments, wherein the first and second mounts are configured to face each other on facing sides of the first and second CSM, respectively.

Embodiment 24

The yoke of any of these embodiments, wherein upper edges of the first and second mounts are substantially co-planar with each other.

Embodiment 25

The yoke of any of these embodiments, wherein lower edges of the first and second mounts are substantially co-planar with each other.

Embodiment 26

A yoke for a ceiling suspension system, the yoke comprising:

a yoke body having an upper end configured to be mounted only to another yoke, or to an extension mounted to said another yoke, a lower end comprising a first mount configured to be mounted to a first ceiling support member (CSM) and a second mount configured to be mounted to a second CSM that differs from the first CSM; and at least one of the first and second mounts is configured to mount to both sides of a respective CSM, including both sides of a bulb and both sides of a web of the respective CSM.

Embodiment 27

A yoke for a ceiling suspension system, the yoke comprising:

a yoke body having an upper end configured to be mounted only to another yoke, or to an extension mounted to said another yoke, a lower end comprising a first mount configured to be mounted to a first ceiling support member (CSM) and a second mount configured to be mounted to a second CSM that differs from the first CSM; and the upper end of the yoke is directly connected to only one of the mounts, and the other of the mounts is directly connected to said only one of the mounts but not to the upper end.

Embodiment 28

A yoke for a ceiling suspension system, the yoke comprising: a yoke body having an upper end configured to be mounted only to another yoke, or to an extension mounted to said another yoke, a lower end comprising a first mount configured to be mounted to a first ceiling support member (CSM) and a second mount configured to be mounted to a second CSM that differs from the first CSM; and the first and second mounts are configured to face each other on facing sides of the first and second CSM, respectively.

Embodiment 29

A yoke for a ceiling suspension system, the yoke comprising: a yoke body having an upper end configured to be mounted only to another yoke, or to an extension mounted to said another yoke, a lower end comprising a first mount configured to be mounted to a first ceiling support member (CSM) and a second mount configured to be mounted to a second CSM that differs from the first CSM; and at least one of upper edges and lower edges of the first and second mounts are substantially co-planar with each other.

Embodiment 30

A yoke system for a ceiling suspension having a grid comprising a plurality of ceiling support members (CSM), a ceiling component located in a discontinuity of the grid between at least two of the CSM, the yoke system comprising: a pair of yokes configured to be mounted directly to each other and to the grid for reinforcing the grid across the discontinuity, wherein the pair of yokes are configured to circumvent the ceiling component by going directly over a top of the ceiling component; and each yoke comprises at least one of the following:

(A) no portion of the yoke is configured to extend through any portion of a CSM;

(B) first and second mounts, at least one of which is configured to mount to both sides of a respective CSM, including both sides of a bulb and both sides of a web of the respective CSM;

(C) an upper end and two mounts, wherein the upper end is directly connected to only one of the mounts, and the other of the mounts is directly connected to said only one of the mounts but not to the upper end;

(D) first and second mounts are configured to face each other on facing sides of respective CSM; and (E) first and second mounts, each with upper and lower edges, and wherein at least one of the upper edges of the first and second mounts and the lower edges of the first and second mounts are substantially co-planar with each other.

Embodiment 31

A yoke assembly for a ceiling suspension having a grid comprising a plurality of ceiling support members (CSM), a ceiling component located in a discontinuity of the grid between at least two of the CSM, the yoke assembly comprising: a pair of yokes mounted directly to each other and to the grid for reinforcing the grid across the discontinuity, wherein the pair of yokes circumvent the ceiling component by going directly over a top of the ceiling component; and each yoke comprises at least one of the following:

(A) no portion of the yoke extends through any portion of a CSM;

(B) first and second mounts, at least one of which is mounted to both sides of a respective CSM, including both sides of a bulb and both sides of a web of the respective CSM;

(C) an upper end and two mounts, wherein the upper end is directly connected to only one of the mounts, and the other of the mounts is directly connected to said only one of the mounts but not to the upper end;

(D) first and second mounts that face each other on facing sides of respective CSM; and (E) first and second mounts, each with upper and lower edges, and wherein at least one of the upper edges of the first and second mounts and the lower edges of the first and second mounts are substantially co-planar with each other.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A yoke for a ceiling suspension system, comprising:

a yoke body having an upper end configured to be mounted only to another yoke, or to an extension mounted to said another yoke, a lower end of the yoke body comprising a first mount configured to be mounted to a first ceiling support member (CSM) and a second mount configured to be mounted to a second CSM that differs from the first CSM, wherein each of the first and second mounts mount to only one side of a respective CSM and substantially follow a contour of each of a bulb and a web of the respective CSM, wherein the first mount includes a horizontal channel that receives a portion of the bulb of the first CSM at least partially therein and extends at least partially over a top of the bulb of the first CSM, wherein the second mount includes a horizontal channel that receives a portion of the bulb of the second CSM at least partially therein and extends at least partially over a top of the bulb of the second CSM, and wherein no portion of the yoke body extends through any portion of the first CSM and the second CSM.

2. The yoke of claim 1, wherein the upper end of the yoke body is generally L-shaped and integrally formed with the first and second mounts from sheet metal.

3. The yoke of claim 1, wherein the first and second mounts are oriented in different directions.

4. The yoke of claim 1, wherein the first and second mounts are substantially perpendicular to each other.

5. The yoke of claim 1, wherein one of the first and second mounts is offset from the upper end of the yoke.

6. The yoke of claim 1, wherein at least one of the first and second mounts is configured to mount to only one side of a respective CSM, including only one side of a bulb and only one side of a web of the respective CSM.

7. The yoke of claim 1, wherein both of the first and second mounts are configured to mount to a top of a respective CSM.

8. The yoke of claim 1, wherein the yoke is configured to not attach to and not structurally support a ceiling component.

9. The yoke of claim 8, wherein the ceiling component comprises a light fixture or a ventilation conduit.

10. The yoke of claim 1, wherein the yoke is configured to be attached adjacent to an intersection of the first CSM and the second CSM, and the yoke is not configured to extend over an intersection between other CSM.

11. The yoke of claim 1, wherein at least one of the first and second mounts is configured to be fastened to a respective CSM with at least one fastener.

12. The yoke of claim 1, wherein the yoke is directly connected to only one of the mounts, and the other of the mounts is directly connected to said only one of the mounts but not to the upper end.

13. The yoke of claim 1, wherein each CSM comprises a main beam, a runner, a cross-tee or a wall support member.

14. The yoke of claim 1, wherein the first and second mounts are configured to face each other on facing sides of the first and second CSM, respectively.

* * * * *